US008165736B2

(12) United States Patent
Gai et al.

(10) Patent No.: US 8,165,736 B2
(45) Date of Patent: Apr. 24, 2012

(54) CONTROL DEVICE FOR WATERCRAFTS

(76) Inventors: Giorgio Gai, Genoa (IT); Giorgio Bosia, Genoa (IT)

( * ) Notice: Subject to any disclaimer, the term of this patent is extended or adjusted under 35 U.S.C. 154(b) by 951 days.

(21) Appl. No.: 12/173,816

(22) Filed: Jul. 16, 2008

(65) Prior Publication Data

US 2009/0030567 A1 Jan. 29, 2009

(30) Foreign Application Priority Data

Jul. 27, 2007 (IT) ..... GE2007A0072

(51) Int. Cl.
*B63H 21/21* (2006.01)

(52) U.S. Cl. ..... 701/21; 440/1; 440/86; 74/502.4; 74/502.5; 74/502.6

(58) Field of Classification Search ..... 701/21; 440/1, 84, 86, 87; 74/480 B, 502.4, 502.5, 74/502.6, 473.15; 123/400
See application file for complete search history.

(56) References Cited

U.S. PATENT DOCUMENTS 4,632,232 A * 12/1986 Kolb et al. ..... 477/112
4,645,462 A * 2/1987 Fulton ..... 440/6
4,925,416 A * 5/1990 Oishi ..... 440/84
5,094,122 A * 3/1992 Okita ..... 74/480 B
5,466,996 A * 11/1995 Gai et al. ..... 318/16
6,077,136 A * 6/2000 Arai et al. ..... 440/86
6,561,861 B2 * 5/2003 Ikuma et al. ..... 440/88 A
6,733,350 B2 5/2004 Iida et al.
6,752,670 B2 * 6/2004 Geil ..... 440/1
6,855,020 B2 2/2005 Kaji
7,247,066 B2 * 7/2007 Harada et al. ..... 440/84

* cited by examiner

*Primary Examiner* — Eric Culbreth
*Assistant Examiner* — Keith Frisby
(74) *Attorney, Agent, or Firm* — Themis Law

(57) ABSTRACT

A control device for watercrafts includes a control station having a control lever, a motor, and an actuator coupled to the motor. In one embodiment, the control lever is provided with a sensor for generating a main command signal that corresponds to or is related to a position and/or a displacement of the control lever. The control device further includes control electronics receiving as input at least the main command signal and further having at least a first analog transmission line and a second digital transmission line for transmitting command signals. The control electronics divide the main command signal in two different command signals, a first analog command signal and a second digital command signal, the first analog command signal being sent to the motor through the analog transmission line and/or the second digital command signal being sent to the actuator through the second digital transmission line.

27 Claims, 7 Drawing Sheets

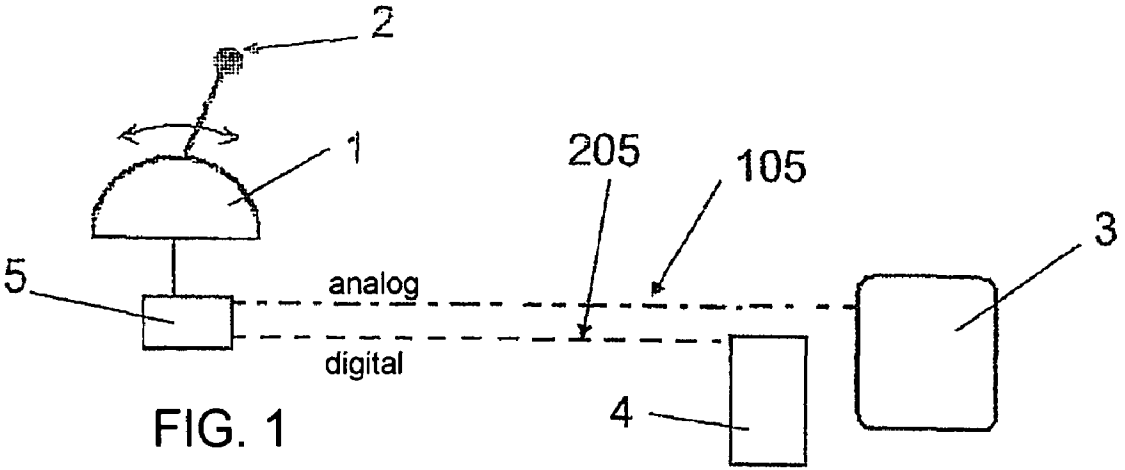
FIG. 1
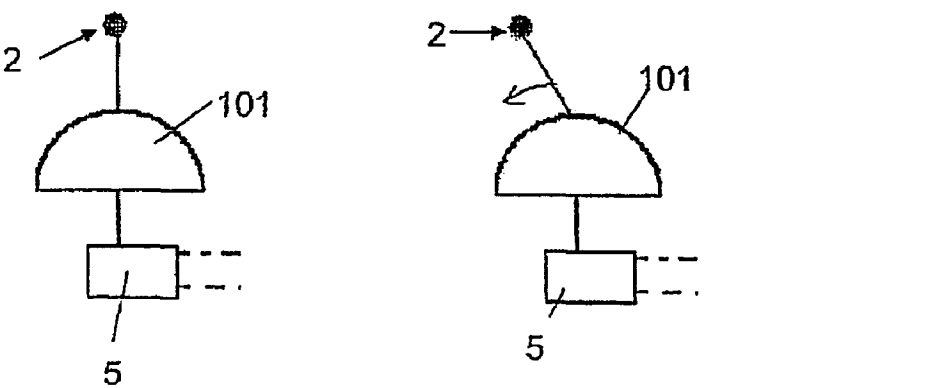
FIG. 7
FIG. 8
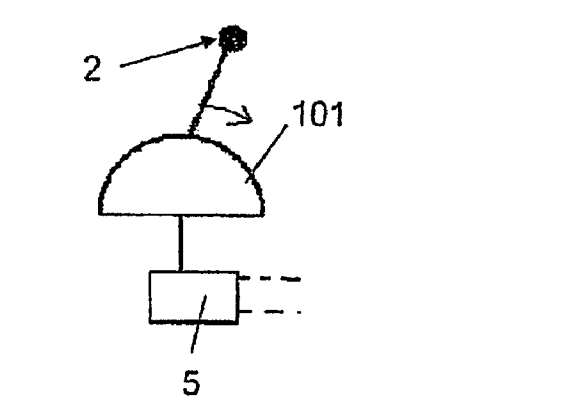
FIG. 9

CONTROL DEVICE FOR WATERCRAFTS

FIELD OF THE INVENTION

The present invention relates to a control device for watercrafts that includes a control station, a motor, and an electromechanical actuator coupled to the motor. The control device of the present invention is employed for transmitting a command signal from a control station to an electromechanical actuator, typically but not exclusively coupled to the motor of the watercraft.

A control station according to the present invention may include a control member, such as a lever, which provides a command signal derived from, or corresponding to, the position and/or displacement of the control member in relation to a specific range and to a specific initial position of the control member, and more particularly to the position and/or displacement thereof. The command signal may be directly sent to the motor by an analog signal, typically a potential difference, acting in turn on a control member of the motor.

In the following description and claims, for the sake of simplicity the control member will be referred to as a lever or a pair of levers. Nonetheless, such term has to be considered as inclusive of any type of control member provided with an element movable along a specific range in relation to an initial or specific reference point provided on such range. The control action is then operably related to the position and/or displacement of such element with regard to the reference point and along the specific range.

The control member is exemplified herein as a control lever because a preferred application of the present invention relates to controlling the number of motor revolutions of a watercraft and to setting travel condition of the watercraft motor, i.e. forward, reverse and neutral.

Information within the command signal often relates to different measurable parameters, such as position or linear or angular displacement of the control lever. The stroke of the control lever transitions progressively from a minimum and, with regard to the control and setting of cruising speed, i.e. the number of motor revolutions, causes the throttle or a similar member to be opened, while with regard to setting the forward, reverse or neutral condition, such condition can be related to the displacement direction of the lever, or alternatively to the position of a second control member provided for setting the desired gear, i.e. forward, reverse or neutral, for example, to the position of a second control lever.

BACKGROUND OF THE INVENTION

Control devices for watercrafts in the prior art are provided in different forms and operate with different principles.

Some of the control devices in the prior art are merely mechanical and include a mechanical cable transmitting the command signal. The mechanical cable is operably and dynamically coupled to the lever and transmits all information regarding the desired position of the lever and the displacement direction of the lever, i.e. the gear to be set and the opening position of the throttle, by moving the cable inside its sheath based on the displacement of the control lever. Information is transmitted to an electromechanical actuator or in certain cases directly to the control member of the motor/transmission assembly, for example directly to the throttle and/or reversing gear.

Therefore, these types of control devices operate on the basis of a mechanical transmission of motion and force.

These types of merely mechanical control devices are inexpensive but suffer from certain drawbacks. Operation, above all in middle-sized watercrafts where the mechanical cable has a considerable length, requires a considerable force on the control lever, moreover, due to assembling and operating tolerances, the command signal is inaccurately transmitted. Other drawbacks are due to the fact that in marine applications a mechanical cable is easily subjected to incrustation, causing malfunctions and/or the transmission of the command signal to be stopped. Moreover, a mechanical cable needs frequent maintenance, above all in an aggressive environment such as the marine environment, causing the user to provide an expensive maintenance. The installation of a device of this kind is also complicated and expensive.

Today, such a merely mechanical device is becoming outdated and it is typically mounted only onto very small-sized and economic watercrafts.

A second type of control device in the prior art is electromechanical. The control lever essentially generates two parallel signals, a first mechanical signal, going for example along a mechanical cable that is dynamically connected to the control lever of a control station, such as the completely mechanical device described above, and a parallel second electric signal, generated for example by a potentiometer connected to the control lever or to another type of electromechanical transducer. The electric signal correspondingly drives an electromechanical actuator, which acts on a member of the motor assembly, for example the throttle, and reduces the force the user needs for acting on the lever, causing a known electromechanical interlocking.

This electromechanical control device exhibits some drawbacks. The signal is not optimally and precisely transmitted, since a part of the signal is transmitted by a mechanical cable, having the drawbacks listed above, in a manner that is similar to the merely mechanical embodiment.

Due to these drawbacks, such electromechanical control devices are not recommended for middle-sized and middle-cost watercrafts, and are more preferably used on economic and small-sized watercrafts.

Another type of control device is a merely electronic, digital device. In this type of device, the lever of the control station is provided with position and/or displacement sensors, which detect information regarding the position and displacement of the control member and transform such quantities into corresponding components of a command signal that is transferred by a communication line, a so-called BUS, particularly a so-called CanBUS, to a control unit of an electromechanical actuator acting on one or more control members of the motor assembly or controlled equipment. In this type of device there is a control unit, which changes the command signal that is generated and detected by sensors connected to the control lever, such that the command signal can be transferred along a merely digital line, such as CanBUS, to the actuator, which receives the command signal and carries out the corresponding action.

Moreover, the command unit includes software for checking the command signal, in order to verify if the signal is properly transmitted along the BUS, that is, if the signal coming to the actuator is the signal transmitted by the control unit.

A first drawback of this type of device is related to cost. A control unit configured to change a series of signals deriving from one or more sensors into corresponding digital command signals to be sent by a digital BUS is relatively expensive, because the signals to be changed and checked are numerous and concern the progressive position of the lever and the gear set or to be set.

Moreover, the control unit must have a relatively high computational ability, since it must be able to verify whether the transmission of digital signals along the BUS is correct, and, therefore, must implement software or similar means for checking whether the signal is properly transferred. In some cases, it is necessary for the checking software to be loaded in a no volatile memory, which is typically integrated into the unit, thereby increasing cost, complexity and sensitivity to damages or malfunctions.

In this type of device, the communication BUS must have such a size and structure to be able to transmit a considerable amount of data, measurable for example at 64 bits/second and corresponding to information about the position of the lever, the displacement direction of the lever and/or position for setting the desired gear, error checking, and error correction. Therefore, a dedicated communication BUS is required, or alternatively digital signals must be caused to pass on the common BUS mounted on all the watercraft. In this second case, the control device uses the BUS to a considerable degree and causes the speed of data transmission to increase and/or may cause error when transmitting data, so a suitably sized BUS must be employed, which is more expensive.

In other words, the amount of information passing through a communication line, for example a BUS, causes said line to be used as a function of the amount of data transmitted and received. Data that are transmitted and received are also checked to verify whether the transmission/reception is congruent, that is whether data are missed or have been transmitted incorrectly and in an incomprehensible manner. Such check is carried out by suitably transmitting additional data or detection bits, causing the BUS to be further used. Therefore, the higher the amount of information is and the more the BUS is used, the higher is the amount of data to be checked, causing the BUS to be used still more. Due to the foregoing, at least 64 bits/second are typically necessary for transmitting data regarding information about position of the lever, displacement direction or position for setting the desired gear, error check, and error correction.

A BUS, especially of the Can type, mounted on a watercraft generally is not used only by the control station, but it is also used by other watercraft equipment, such as the wheel or rudder, maneuvering propellers, watercraft lights or drive assisting systems.

The amount of information using a BUS on a watercraft, for example command signals and signals checking or verifying errors in the transmission, is therefore quite high, and the more information or data passing inside the BUS is reduced, the less the BUS is used and the transmission becomes faster and free from errors. This requires alternatively the use of a communication BUS able to stand a large amount of data, which is expensive, or the use of various communication BUSes, and, in an undesirable scenario, a BUS dedicated for each piece of equipment, with considerable drawbacks as far as costs and mounting problems are concerned.

As it can be seen, even if the merely electronic device of prior art can overcome drawbacks of the merely mechanical or electromechanical devices, a merely electronic device, in which data are transmitted only as digital signals, has a mounting cost that is considerably higher than for the other two above described types of control devices, and is suitable for the use only in large-sized and correspondingly expensive watercrafts. The cost of such a merely electronic device for middle-sized watercrafts it is often too high in relation to the cost of the watercraft itself.

With regard to reliability and to the consequences of an error in transmitting the command signal, the heavy damages should be considered that would occur, for example, during mooring if the transmission of the command signal has errors or deviations with respect to what had been set and desired by the user acting on the control lever, and the dangerous condition should also be considered that could derive from a systematic error of the control system.

Therefore, there is a need of a device, which, while acting without mechanical transmission, that is, with the transmission of electrical signals, has a limited cost, comparable or almost comparable to the cost of a mechanical or electromechanical device, and which also has a high reliability and a reduced maintenance cost, making such device comparable or almost comparable to a merely electronic device.

SUMMARY OF THE INVENTION

The present invention relates to a control device for watercrafts that is designed to solve at least some of the drawbacks of prior art devices.

The control device for watercrafts according to the present invention includes a control station provided with a control lever, a motor, and an actuator associated to the motor, wherein the control lever is provided with one or more sensors for generating a main command signal corresponding to a position and/or a displacement of the control lever. In one embodiment, the control device also includes control electronics configured to receive as input at least the main command signal, and also include two different lines for transmitting command signals, that is, a first analog transmission line and a second digital transmission line. The control electronics are designed to divide the main command signal in two different command signals, a first analog command signal and a second digital command signal, wherein the first analog command signal is sent to the actuator through the analog transmission line and the second digital command signal is sent to the actuator through the second digital transmission line.

Therefore, the present invention advantageously provides a new type of control device for watercrafts, in which the command signal is divided into an analog signal and a digital signal, each sent to the actuator via a corresponding and dedicated line. Briefly, the present invention provides a new analog-digital control device.

In one embodiment, a command set by the user on the control lever is transmitted to the control unit in any form.

In a variant of this embodiment, there is provided one lever for controlling motor revolutions and for setting the gear. In this variant, a digital sensor is coupled to the control lever, such as a magnetic sensor or the like, or an analog sensor, such as a potentiometer or the like, or even a mechanical sensor, such as a section of a mechanical cable or any combination thereof.

The sensor sends the command signal corresponding to the position and/or displacement, and the displacement direction with respect to a specific reference position of the lever, to the control unit, which divides the command signal into two different signals, an analog signal and a digital signal.

In this embodiment, the analog command signal contains at least information about the position or the progressive displacement of the lever, for example but not exclusively in the form of a potential difference, while the digital command signal contains at least information about the desired gear, that is forward, reverse or neutral, which information corresponds for example to the displacement direction of the lever in relation to a specific reference position.

In another variant, a control lever is provided for controlling the number of motor revolutions and a separated control member is also provided for setting the gear, for example a commutator or a lever having a plurality of predetermined angular positions, each one corresponding to the command that sets a specific gear among the different gear conditions that are available.

In this variant, the control lever with the motor in the accelerated condition, i.e. when the number of revolutions are set, generates the analog command signal by means of suitable sensors or transducers, while the control member setting the gear generates the command digital signal that sets the gear also by means of suitable sensors or transducers.

One advantage of the device according to the present invention is the limited cost, which can be compared or almost compared to the cost of a mechanical or electromechanical device, and also a high reliability and lack of maintenance, which can be compared to, or almost compared to, those one of merely electronic devices.

By providing an analog line transmitting command signals, along which the analog command signal related to the position of the control lever and, accordingly, the control of the number of motor revolutions is transmitted, a very small amount of information is required to be transmitted along the digital line for controlling the gear condition, for example, only 4 bits/second may be required versus the 64 bits/second that are required for a completely electronic device.

The digital signal is transmitted to the actuator through the digital transmission line, generally a BUS, preferably a CanBUS. A digital signal intended to transfer only a piece of information contained in the main command signal set by the control lever uses a very small number of bits, for example, a digital command signal that is intended to transmit only the command signal engaging a gear can be of only 4 bits/second and uses a very thin band with respect to the overall band of the BUS. Advantageously, a simplified CanBUS may be employed and/or said BUS may be overcharged to a smaller extent. Because errors are less frequent, the use of the BUS is reduced, obtaining a considerable increase in transfer speed and accuracy of the signal transmission, with fewer check actions.

A further advantage of a device according to the present invention resides in the simplified control electronics. Hardware or software for correcting errors during the transfer of command signals can be advantageously reduced with respect to a completely electronic device, since the amount of information to be checked is significantly reduced, and, in comparison with known electronic devices, goes from 64 to 4 bits/second. Therefore, hardware or software for checking errors that typically monitors the transmission of digital signals, for example, suitable software or not volatile memories, can be considerably simplified, leading to reduced costs while still maintaining the advantages of an entirely digital transmission.

The analog command signal instead is most suitable for transmitting the signal related to the position and/or the angular displacement of the control lever, since such signal is a progressive signal indicating the position or the progressive displacement of the lever, in opposition to the set gear signal, which is a discrete signal and possibly a on/off signal. Therefore, the analog transmission line is particularly advantageous in transmitting said type of command signal and has considerable advantages in comparison to mechanical or electromechanical devices, requiring less maintenance, and is also safer when compared thereto.

Additional features of the invention are the object of the annexed independent and dependent claims.

BRIEF DESCRIPTION OF THE SEVERAL VIEWS OF THE DRAWINGS

These and other characteristics and advantages of the present invention will be made clearer from the following description of some embodiments illustrated in annexed drawings, in which:

FIG. 1 is a diagrammatic representation of a device according to the present invention;

FIGS. 7, 8 and 9 illustrate a control lever in three operating positions;

DETAILED DESCRIPTION OF EMBODIMENTS OF THE INVENTION

Figure 2:
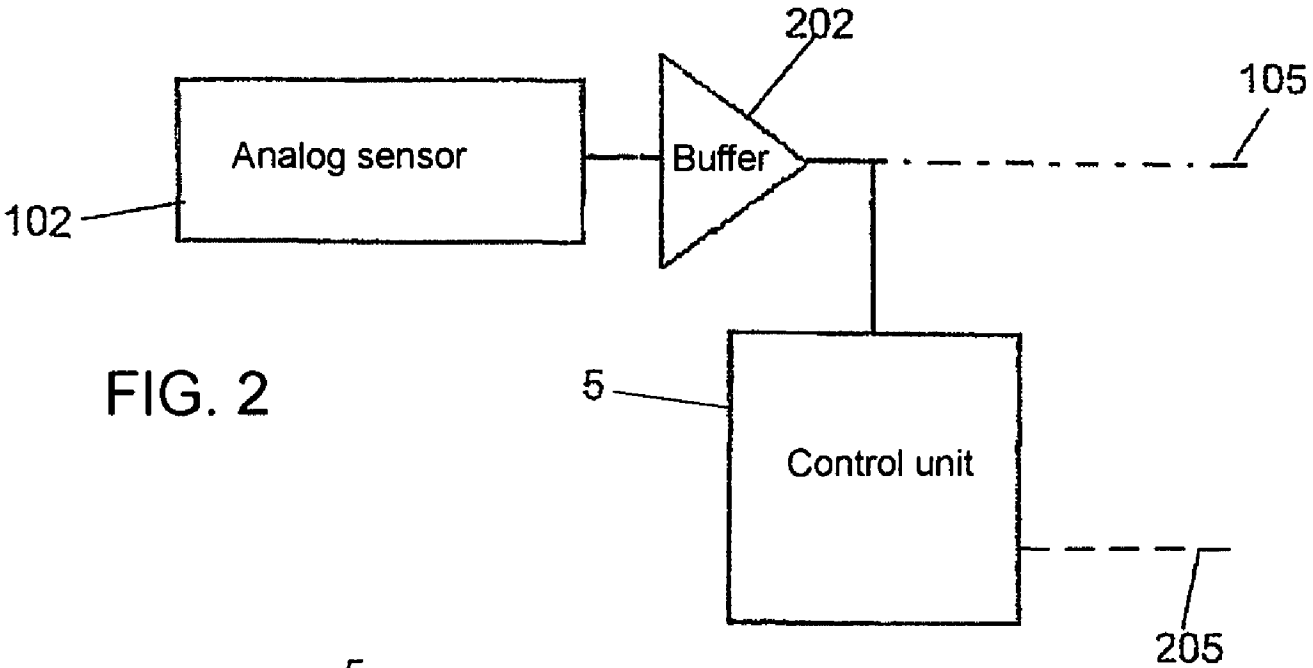
FIG. 2 is a detail diagram of a first embodiment of a device according to the present invention.

Detailed descriptions of embodiments of the invention are provided herein. It should be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

FIG. 1 is a preferred embodiment of a control device for watercrafts according to the present invention, particularly for watercrafts that include at least a control station 1 provided with at least a control lever 2, a motor 3, and an actuator 4 coupled to motor 3.

Control lever 2 is provided with one or more sensors for detecting a main command signal that can be set by control lever 2.

Lever 2 is operated by a user, typically for controlling motor or motors 3 of the watercraft. Inputs set by the user by a single lever 2 relate to gear and number of revolutions of motor 3, for example FIGS. 7, 8 and 9 show three positions of a single control lever 2, more particularly, lever 2 in the position of FIG. 7 corresponds to the minimum number of revolutions of motor 3 and to the "neutral" gear, that is, the motor propeller does not rotate. In FIG. 8 the position of lever 2 provides that the forward gear is set, and by progressively moving lever 2 from the neutral position of FIG. 7 to the maximum travel of lever 2, a progressive and corresponding increase in the number of revolutions of motor 3 takes place. Similarly considering the device in the embodiment of FIG. 9, a progressive increase in the number of revolutions of motor 3 occurs that corresponding to the progressive displacement of the lever 2, while the reverse gear is set.

As an alternative, a first control lever may be provided for controlling the number of motor revolutions and a separated control member may also be provided for setting the gear, such as a second commutating lever, a commutator or the like.

In the latter embodiment, the commutating lever provides a plurality of predetermined angular positions, each one corresponding to the command for setting a gear among available gears, typically but not exclusively among three gear conditions, i.e. forward gear, reverse gear, and neutral or disengagement.

Therefore, in a device of the type described herein, there are provided two levers or one lever and a commutator, and the user operates the first control lever in order to set the number of revolutions of the motor, transmitting an analog signal thereto, and he also operates the commutator or the second lever in order to set the desired gear, transmitting to the motor, that is, to the electromechanical actuator of the reversing gear, a digital signal that sets the corresponding gear or that is operably related to the position of the second commutating lever.

As discussed later in greater detail, a first control lever 2, 2' is coupled to sensors or transducers of the mechanical/analog type and generates an analog command signal setting the number of revolutions of motor 3. The control member setting the gear, i.e. a commutating lever 2" or 2'" generates the digital command signal setting the gear through electromechanical transducers configured for generating a digital signal.

More generally, both in case of a single lever that is essentially movable in two directions to set the gear and the number of revolutions, and in case of a separate lever for adjusting the number of revolutions and of a control member for setting the gear, the sensor or sensors detecting and/or generating a command signal corresponding to, or operably related to, the position and/or the displacement of control lever 2 are electromechanical sensors such as a potentiometer associated to control lever 2 or the like, or in alternative is an electric/electronic and/or digital sensor, such as a magnetic sensor associated to control lever 2 or the like.

Figure 3:
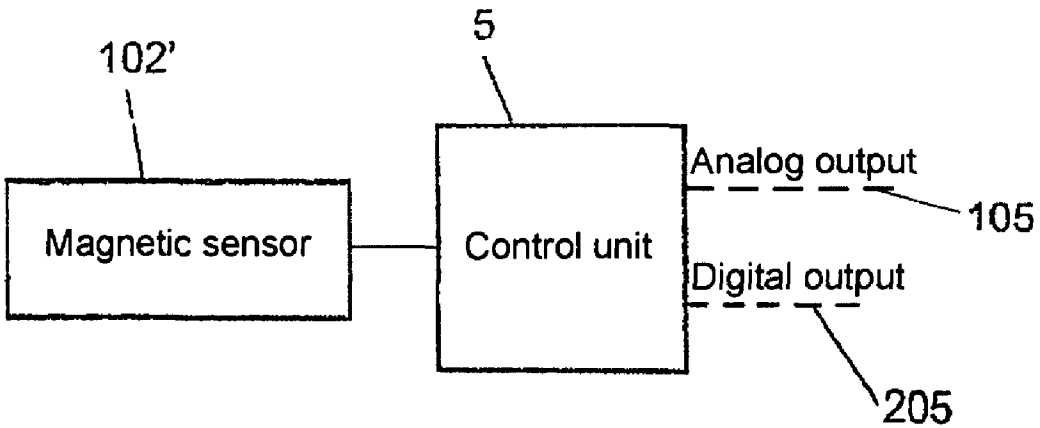
FIG. 3 is a detail diagram of a second embodiment of a device according to the present invention.

Moreover, the device includes control electronics 5 intended to receive as input at least the command signal, anyhow transmitted to control electronics 5, and further includes at least two different lines for transmitting command signals, a first analog transmission line 105 and a second digital transmission line 205, as shown in FIGS. 1, 2 and 3.

Control electronics 5 divide the main command signal into two different command signals, a first analog command signal and a second digital command signal, which are sent to actuator 4 by analog transmission line 105 and digital transmission line 205.

The command signal received as input by control electronics 5 is a command signal containing information regarding the position or displacement and the displacement direction with respect to a specific reference position of lever 2.

In another embodiment, control electronics are not provided, but the command signal is directly sent from analog and/or digital sensors to the actuator 3 of motor 4 or the like with two separated transmission lines, an analog transmission line and a digital transmission line, each one connected to respective sensors or transducers, analog and digital.

More particularly, the analog signal is a command signal containing at least information about the position or the progressive displacement of the corresponding control lever, for example as a potential difference.

On the contrary, the digital command signal contains at least information about the desired gear, and said information can be operably related to or corresponds to the displacement direction of lever 2 with respect to a specific reference position, but can contain also information about error detections or the like.

Generally, an information transmission occurs in the digital line that is lower than 10 bit, and preferably an information transmission occurs with a band substantially equal to 4 bit and equal to information about the set gear.

In FIG. 2, there is shown an embodiment that includes a sensor/transducer 102 of the analog type, intended to be dynamically connected to control lever 2 and to detect displacements and/or the progressive position of lever 2 and/or the displacement direction. An example of analog sensor 102 might be a potentiometer that is dynamically connected to control lever 2 and that is provided with a rotating driving shaft rotatably operated by the angular movement of lever 2 by direct transmission or by a kinematic transmission chain.

In this configuration, the command signal is already in the form of an analog command signal and passes in a buffer 202, from which it is sent both to control electronics 5 and is converted in a corresponding digital signal, and it is further sent it through the digital line or digital output of control electronics 5, and to analog line 105 which directly transmits it to actuator 4 associated to motor 3 or to motor 3.

In the embodiment illustrated in FIG. 3 instead there is provided a digital sensor 102' intended to be connected to control lever 2 and to detect displacements and/or the progressive position of lever 2 and/or the displacement direction. An example of a digital sensor 102' might be, for example, a magnetic sensor with a digital output that is associated to the lever base.

In this configuration, the command signal is in the form of a digital command signal and is sent both to control electronics 5, which divide it into a corresponding digital signal and a corresponding analog signal, which are sent through digital line 105 or as a digital output of electronics 5 and through analog line 205 or as an analog output of electronics 5.

The digital transmission line is a preferably a BUS line, for example, a CanBUS.

Figure 4:
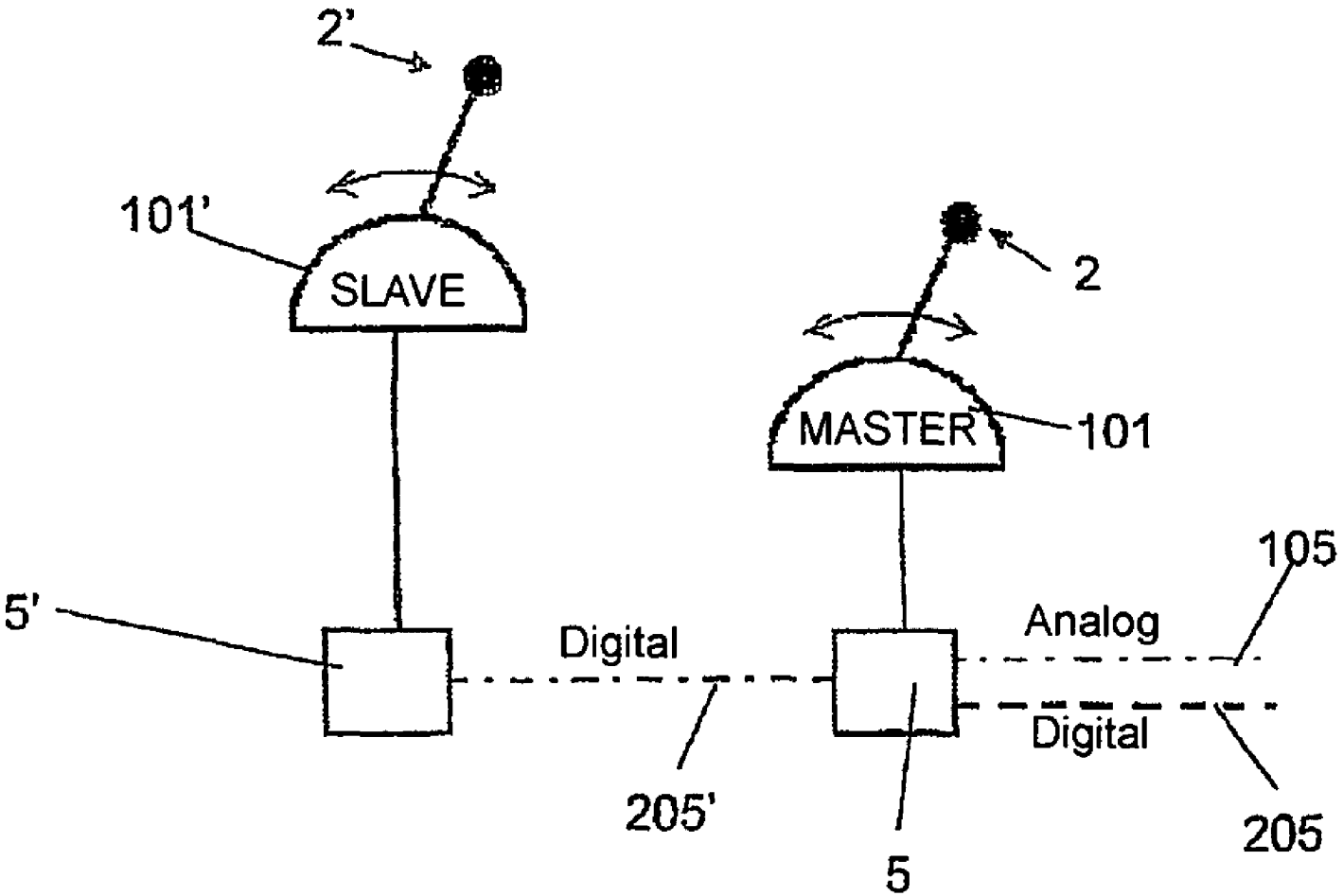
FIG. 4 is an embodiment of a device according to the present invention that includes two control stations.

FIG. 4 shows an embodiment wherein there are two control levers, a first lever 2 and a second lever 2' provided in two different control stations, respectively a first station 101 and a second station 101'. These stations can be placed at different locations in the watercraft.

Beyond the sensor mounted onto second lever 2' of station 101', the command signal of lever 2' is sent to control electronics 5', which change it into an analog signal or a digital signal, preferably into a digital signal, and send it to control electronics 5 of first lever 2, which divide said signal into an analog signal and a digital signal and send it to motor 3 and/or actuator 4.

In this configuration, the system comprises a first lever 2, so called MASTER lever, which first lever 2 is connected to two transmission lines, a digital one and an analog one, which are connected to an actuator or directly to one or more motors.

Moreover, there is provided a second lever 2', so called SLAVE lever, that can be selected by the user as the lever by which the user inputs the command for the motor or motors.

SLAVE lever 2' communicates with MASTER lever 2 preferably only through a communication line 205' of the digital type, preferably a BUS line and more preferably a CanBUS, through which the command signal is sent to control electronics 5 of MASTER lever 2. Control electronics 5 divides the signal into a digital part, for example regarding the set gear, and into an analog part, for example regarding the position or progressive displacement of SLAVE lever 2'.

If a SLAVE lever 2' is provided, through which the user inputs commands, MASTER lever 2 is advantageously provided with a servomechanism for operating MASTER lever 2, such that it corresponds to the command set by the user on the SLAVE lever 2'.

Figure 5:
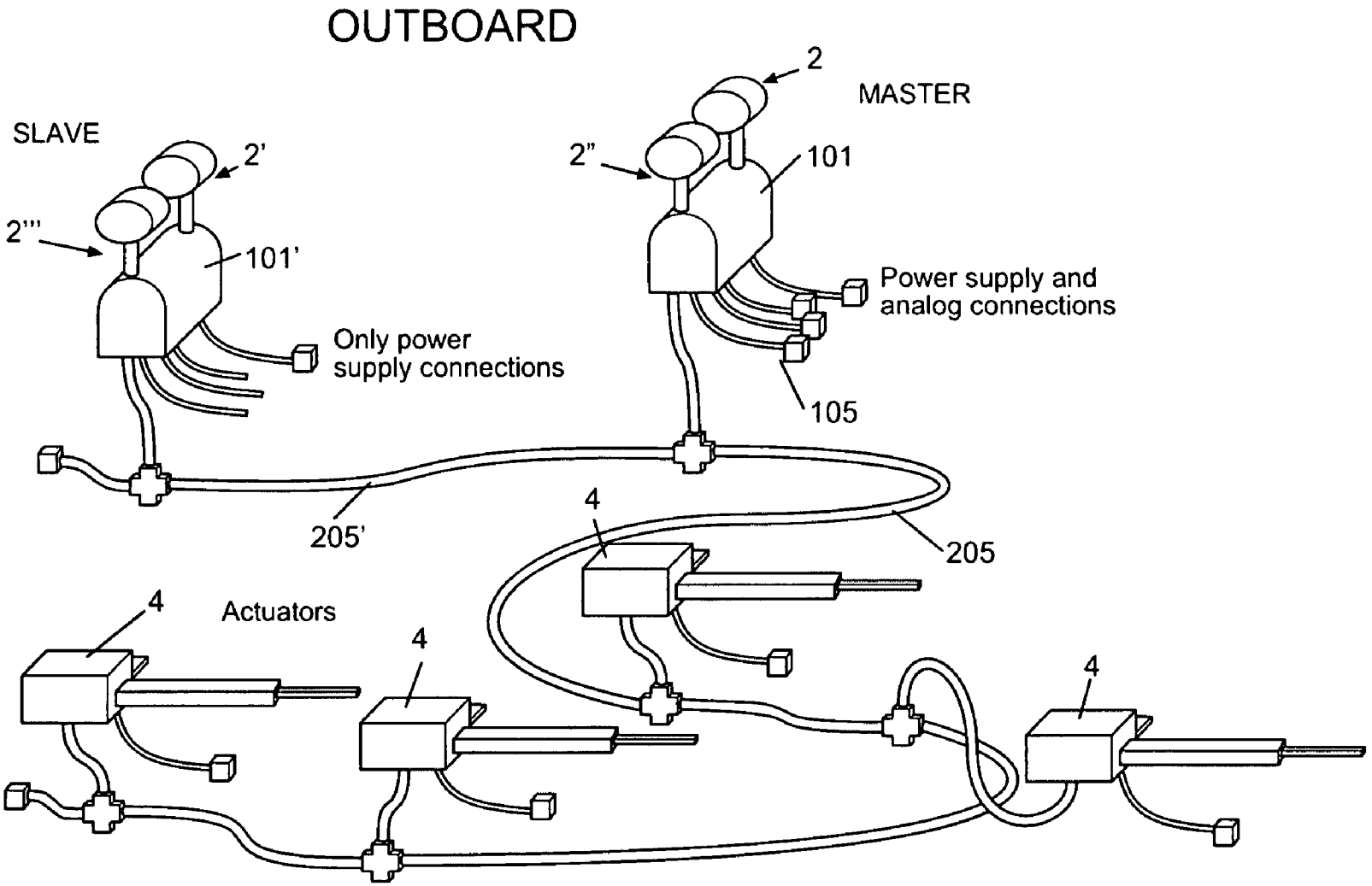
FIG. 5 is an embodiment of a device according to the present invention that includes two control stations when outboard motors are employed.
Figure 6:
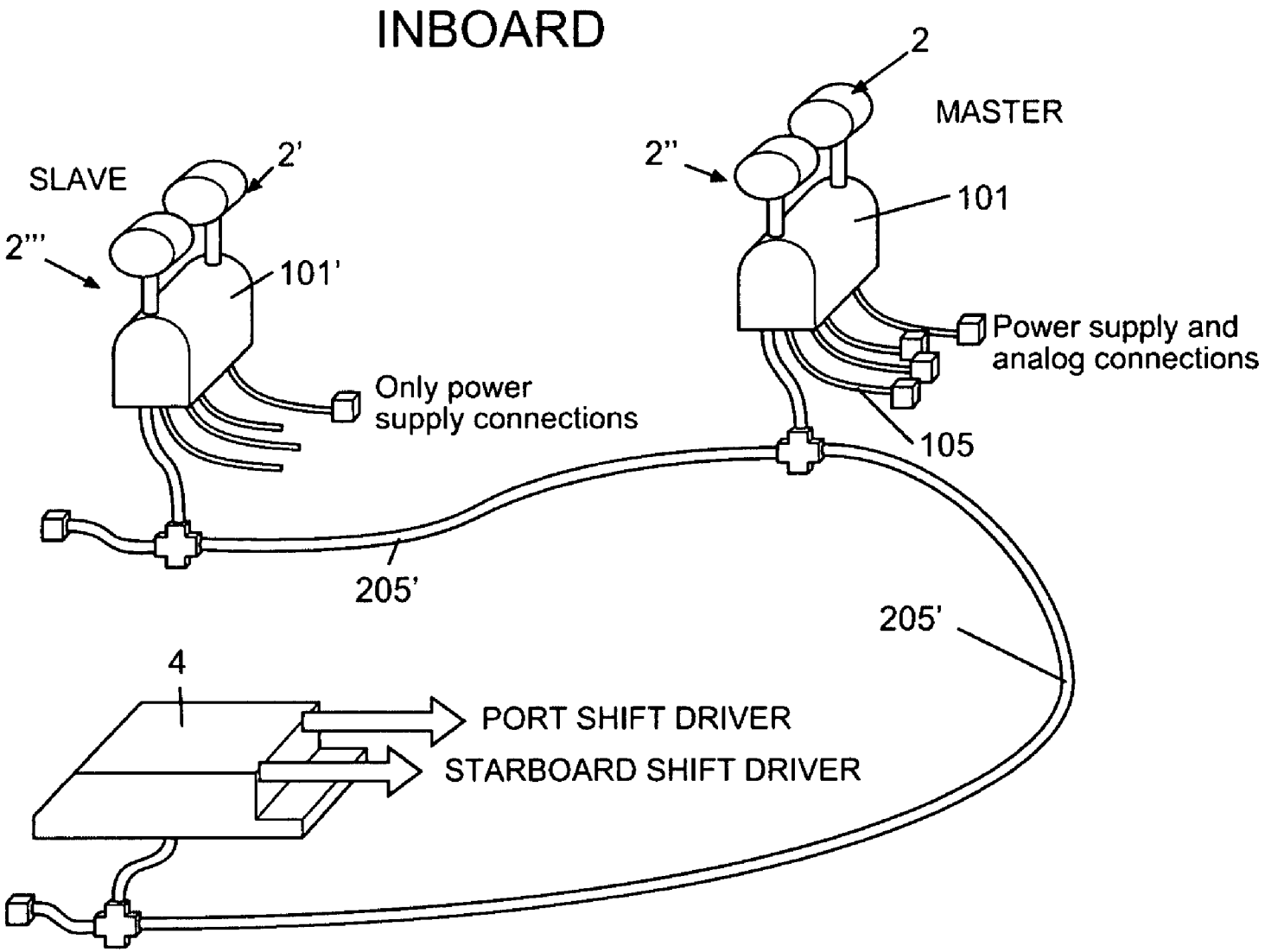
FIG. 6 is an embodiment of a device according to the present invention that includes two control stations when inboard motors are employed.

Two preferred embodiments are now described, the embodiment of FIG. 5 being particularly advantageous for watercrafts provided with outboard motors, and the embodiment of FIG. 6 for watercrafts provided with inboard motors.

FIG. 5 shows an embodiment, in which two different control stations MASTER 101 and SLAVE 101' are each provided with two control levers 2, 2', 2" and 2'".

As shown in FIG. 5, there are provided four actuators 4 and a first transmission line 205', which connects station 101' to station 101, and which is composed of a digital transmission line, preferably a BUS and more preferably a CanBUS.

In this embodiment, each lever 2, 2', 2" and 2'" may control one, two, three or more actuators according to the above description.

Advantageously, in this embodiment first transmission line 5' may be made integrally with transmission line 5 that connects MASTER station 101 to actuators 4, for example by manufacturing these lines as a single digital transmission line such as a CanBUS or the like and not as two separated transmission lines.

The embodiment illustrated in FIG. 6 is particularly applicable in the case of inboard motors. In this configuration, there is only one actuator 4, but it is possible to provide for more than one actuator.

Moreover, without departing from the principles and the objectives of the present invention, there can be provided more than two control stations, for example, there can be provided three, four or more control stations, wherein at least one control station is intended to be a MASTER control station in the manner described above.

In one embodiment, a device according to the present invention can have the command signal divided into a digital part and an analog part, wherein the digital part of the command signal transmitted on digital line 205 contains also a command signal exactly like the one transmitted along the analog line, such that the signal part of the analog signal can be checked, or otherwise it would be virtually free from checking.

The checking of the correct transmission of the analog signal can be made at the actuator, by the actuator or by a dedicated checking electronics that verify the correct transmission of the analog signal by comparing it with the digital signal.

In this event, in order not to overcharge the BUS with a continuous command signal corresponding to the analog command signal, the check is not carried out continuously but at preferred intervals, that is, the correspondence between the digital signal corresponding to the analog signal and the analog signal is checked only at predetermined intervals, for example 5 seconds, 10 seconds, 60 seconds, or only when the device is operated.

Figure 10:
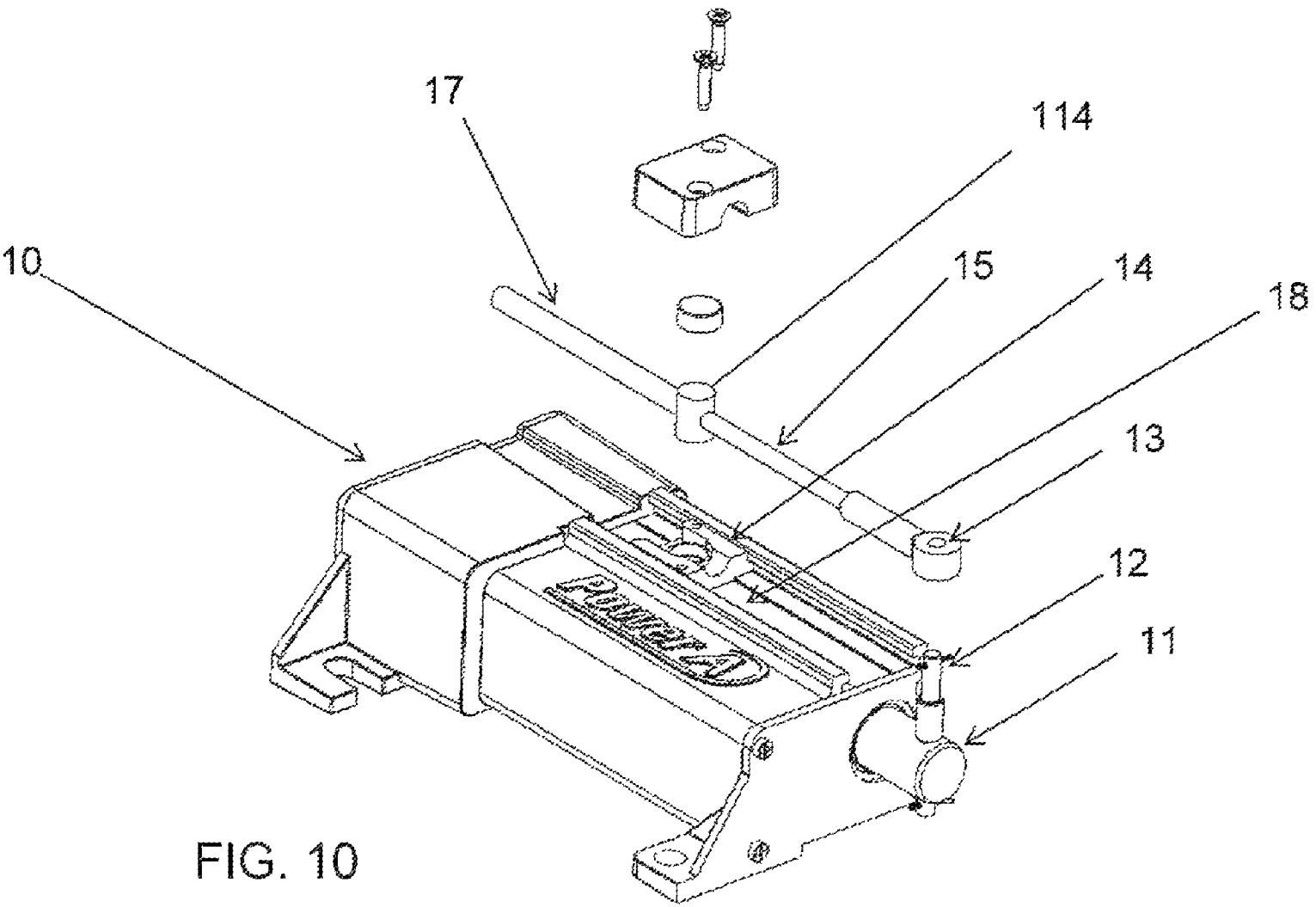
FIG. 10 is an exemplary actuator according to the present invention.
Figure 11:
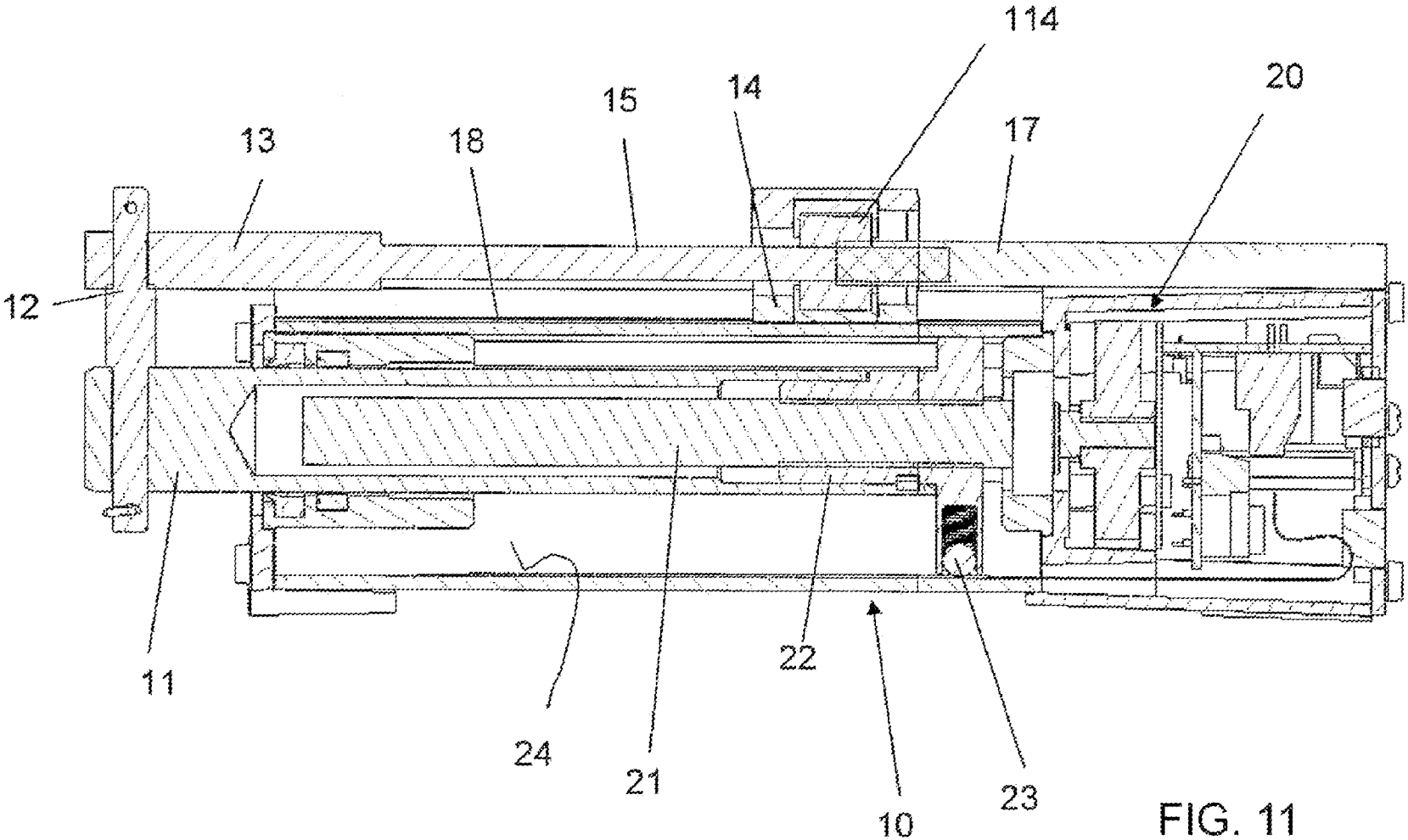
FIG. 11 is a section view of the actuator of FIG. 10 along a diametral plane of the stem and perpendicular to the bottom side of the actuator housing.

In combination with the device of the present invention, actuating means 10 may be provided such as shown in FIGS. 10 and 11.

When the command signal generated by control lever 2 and transmitted by actuator 10 has to be transformed into a mechanical actuating movement with a stroke corresponding to the electric or electronic signal, and particularly a stroke transmitted to motor 3 or to a member driven by actuator 10, an actuator acting on a mechanical cable 15 which transmits the actuating movement is used, while mechanical cable 15 in turn acts on the controlled member, for example a throttle or the like.

The assembling of a normal cable 15 according to the prior art is made on actuator 10, according to the present embodiment, by securing sheath 17 of cable 15 onto a stationary fastening terminal, while head 13 of cable 15 is integral with a mobile member, in this case a stem 11 of a linear actuator, by means of coupler 12.

The location where the sheath 17 is secured defines the type of cable that can be used, since the distance between cable head 13 and sheath 17 is characteristic for different types of cables, and particularly for identical types of cables made by different manufacturers.

Actuator 10 according to the present embodiment provides a terminal for fastening sheath 17 of cable 15, which is movable with respect to coupler 12, which in turn is coupled to cable head 13. In particular, this is achieved by means of a slide 14 sliding onto a guide 18 that is integral with the body of actuator 10 in the direction towards and away from coupler 12 on stem 11.

When coupler 12 is provided at the end of stem 11 in a linear actuator, slide 14 bearing the terminal fastening sheath 17 can be moved in a direction parallel to the axis of stem 11, i.e. in its displacement direction, by a corresponding arrangement of guide 18. Thus, both the stationary piece and the mobile piece are part of actuator 10 in the present embodiment.

Since the terminal fastening sheath 17 is provided on a slide, the distance of the location may be changed where sheath 17 is fastened or secured, so to adapt actuator 10 for any type of selected cable, apart from the distance between cable head 13 and the location where the sheath is fastened.

Once the desired length is selected, the slide is stopped in place by tightening two screws or by other securing or stopping member.

If the type of cable must be changed, it is sufficient to release the slide, introduce the new cable, correspondingly locate the slide in the new position and secure it.

Cables are characterized not only with regard to the distance between sheath and head as described above, but also with regard to the type of terminal that fastens the sheath, that usually is a cylinder 114 whose size changes depending on the model.

Advantageously, slide 14 of the terminal fastening sheath 17 according to the present embodiment has such a seat to house different types of cylinders 114 fastening sheath 17, such that actuator 10 of the present embodiment is still more versatile.

Also advantageously, the system for positioning stem 14 is includes a linear position sensor, such as a potentiometer or the like, detecting the position of stem 14 as an electric signal, which position is then used for an absolute position feedback for the device of the present embodiment, such that the correspondence between the command of the user and the command sent to motor 3 or to a member of motor 3 can be checked at predetermined intervals.

With reference to FIG. 11, actuator 10 is shown in a section view along a diametral plane of stem 11, perpendicularly to the bottom side of the case of actuator 10. Hollow stem 11 at one end has a female screw 22 not rotatably fastened thereto. A threaded shaft 21 engages female screw 22, which shaft 21 is rotatably supported about its axis and with respect to female screw 22 and is rotatably driven by a motorized transmission generally denoted by reference numeral 20. Axially slidable stem 11 and female screw 22 have a control member 23 of a position sensor or a stroke measuring device of stem 11 denoted by reference numeral 24, which is provided parallel to stem 11 and in the displacement direction thereof. More particularly, stroke measuring device or position sensor 24 are of the electric type such as a linear potentiometer or the like. In the present embodiment, position sensor or a stroke measuring device 24 is a contact potentiometer and control member 23 is a tracer point in the form of a contact ball that is elastically urged against the sensitive band of potentiometer 24. However, other similar solutions using other known types of sensors 24 are possible.

While the invention has been described in connection with a number of embodiments, it is not intended to limit the scope of the invention to the particular forms set forth, but on the contrary, it is intended to cover such alternatives, modifications, and equivalents as may be included within the scope of the invention.

What is claimed is:

1. A control device for a watercraft having a motor and an actuator coupled to the motor, the control device comprising:

a control station comprising, a control member comprising a sensor that generates a main command signal corresponding to or related to one or more of a position or a displacement of the control member, and control electronics configured to receive as input the main command signal, the control electronics comprising an analog transmission line and a digital transmission line, the control electronics dividing the main command signal into an analog command signal and a digital command signal, the analog command signal being transmitted to the actuator by the analog transmission line and the digital command signal being transmitted to the actuator by the digital transmission line.

2. The control device of claim 1, wherein the control member is a control lever.

3. The control device of claim 1, wherein the sensor that generates the main command signal is a mechanical sensor.

4. The control device of claim 1, wherein the sensor that generates the main command signal is an electromechanical sensor.

5. The control device of claim 1, wherein the sensor that generates the main command signal is an electric, electronic, or digital sensor.

6. The control device of claim 1, wherein the main command signal is a command signal containing information corresponding to, or operably related to, one or more of the position, the displacement, or a displacement direction of the control member in relation to a specific reference position of the control member.

7. The control device of claim 1, wherein the analog command signal contains at least information about one or more of the position or the displacement of the control member.

8. The control device of claim 7, wherein the information about one or more of the position or displacement of the control member is expressed as a potential difference.

9. The control device of claim 1, wherein the digital command signal contains at least information about a desired motor gear, and wherein the information is operably related to, or corresponding to, a displacement direction of the control member in relation to a specific reference position.

10. The control device of claim 1, wherein the control member comprises a first control member for controlling a number of motor revolutions and a second separate control member for setting a motor gear.

11. The control device of claim 10, wherein the second control member for setting the motor gear is a commutator or a commutating lever.

12. The control device of claim 11, wherein the commutator or the commutating lever provides a plurality of predetermined angular positions, each of the predetermined angular positions corresponding to or operably related to a command setting a specific motor gear among the different available motor gears.

13. The control device of claim 10, wherein the first control member generates the analog command signal, which sets the number of motor revolutions.

14. The control device of claim 13, wherein the analog command signal is generated by one or more sensors or transducers configured to generate analog signals.

15. The control device of claim 10, wherein the second control member for setting the motor gear generates the digital command signal, which sets the motor gear.

16. The control device of claim 15, wherein the digital command signal is generated by one or more sensors or transducers configured to generate digital signals.

17. The control device of claim 1, wherein the digital transmission line provides an information transmission lower than 10 bits/second.

18. The control device of claim 1, wherein the digital transmission line provides an information transmission of about 4 bits/second.

19. The control device of claim 1, wherein the digital transmission line is a BUS.

20. The control device of claim 1, wherein the control member comprises first and second control members.

21. The control device of claim 20, wherein the second control member is provided with at least a sensor for detecting one or more of a position, a progressive displacement of the second control member, or a displacement direction of the second control member in relation to a specific reference position or a desired motor gear.

22. The control device of claim 20, wherein the second control member is provided with second control electronics configured for receiving as input at least the command signal of the second control member about one or more of the position, the progressive displacement of the second control member, or the displacement direction of the second control member in relation to a predetermined reference position and/or a desired motor gear, and further for transforming the command signal of the second control member into a corresponding digital command signal to be sent to one or more of the control electronics of the control member, to the control member, or to a digital sensor of the control member.

23. A control device for a watercraft having a motor, the control device comprising:

a control station comprising, a control member, and an actuator coupled to the motor, the actuator being configured for receiving command signals generated by the control member, the actuator being coupled to a cable transmitting an actuating or control movement to the motor, the cable having an outer sheath and a coupling head, wherein a portion of the cable projects from the outer sheath, the actuator comprising fastening means for fastening the sheath in a predetermined position in relation to a coupler connected to the coupling head, the coupler extending from an actuating member of the actuator, wherein the fastening means are movable in relation to the coupler and are securable in, and releasable from, a predetermined position in relation to the coupler, and wherein the fastening means comprise a slide, wherein the sheath further comprises a coupling terminal configured to be received in, and secured to, the slide, and wherein the slide is securable and releasable along a guide oriented in a direction towards and away from the coupler.

24. The control device of claim 23, wherein the actuating member causes a movement stroke of the cable and is provided in combination with a position sensor or with means for measuring the movement stroke, and wherein the means for measuring are driven by the actuating member.

25. The control device of claim 24, wherein the position sensor or the means for measuring comprise a linear potentiometer driven by the actuating member.

26. The control device of claim 25, wherein the linear potentiometer is of the contact-responsive type, and wherein a tracer point controlling the linear potentiometer is coupled to the actuating member.

27. The control device of claim 23, wherein the actuator transforms electric or electronic command signals into mechanical control movements of the motor or of other components of the watercraft, wherein the control member comprises a sensor that generates a main command signal corresponding to, or related to, one or more of a position or a displacement of the control member, and wherein the control station further comprises control electronics configured to receive as input the main command signal, the control electronics comprising an analog transmission line and a digital transmission line, the control electronics dividing the main command signal into an analog command signal and a digital command signal, the analog command signal being transmitted to the actuator by the analog transmission line and the digital command signal being transmitted to the actuator by the digital transmission line.

* * * * *